United States Patent [19]

van den Berg

[11] 3,965,728

[45] June 29, 1976

[54] APPARATUS FOR COMPENSATING MOVEMENTS OF AN APPARATUS FOR MEASURING OR RECORDING DISPLACEMENTS IN RESPECT OF A FIXED REFERENCE SURFACE

[75] Inventor: Arie Pieter van den Berg, Heerenveen, Netherlands

[73] Assignee: Ingenieursbureau A.P. van den Berg B.V., Heerenveen, Netherlands

[22] Filed: July 9, 1974

[21] Appl. No.: 486,870

[30] Foreign Application Priority Data

July 9, 1973 Netherlands ..... 7309584

[52] U.S. Cl. ..... 73/84

[51] Int. Cl.[2] ..... G01N 3/00

[58] Field of Search ..... 73/84, 88 E; 33/147 D, 33/148 D, 1 H, 169 B

[56] References Cited

UNITED STATES PATENTS

| | | | |
|---|---|---|---|
| 2,280,592 | 4/1942 | Mieux | 73/84 |
| 2,650,432 | 9/1953 | Adams | 33/147 D |
| 3,001,396 | 9/1961 | Cleveland | 175/5 |
| 3,600,939 | 8/1971 | Steele et al. | 33/147 D |
| 3,660,904 | 5/1972 | Steele et al. | 33/147 D |

*Primary Examiner*—James J. Gill
*Assistant Examiner*—Anthony V. Ciarlante
*Attorney, Agent, or Firm*—George F. Smyth

[57] ABSTRACT

An apparatus for use in soil sounding in which a probe is mounted on a vehicle includes an improved simple device for monitoring the displacement of a reference surface from the ground level in order to provide an accurate indication of the position of the probe. One sensor indicates the displacement of the probe and the reference surface, which displacement is greater than the actual displacement of the probe into the ground. Another sensor indicates the displacement of the reference surface relative to the ground, these displacements being imputs to a subtractor which provides an output representative of the true displacement of the probe relative to the ground level.

9 Claims, 2 Drawing Figures

Figure 1:
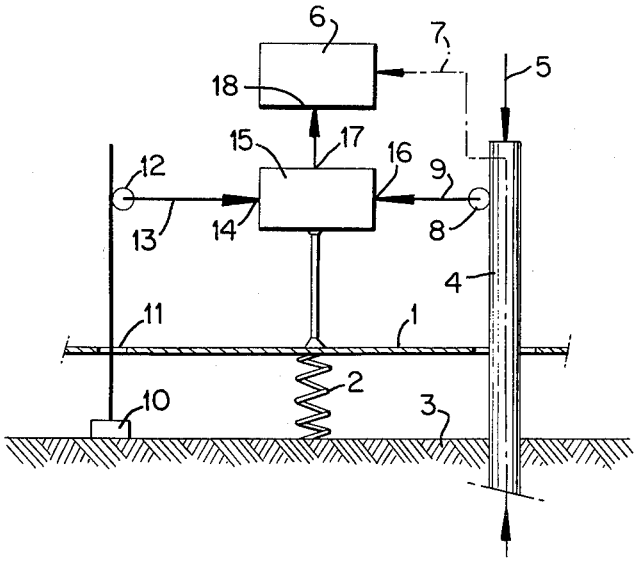

APPARATUS FOR COMPENSATING MOVEMENTS OF AN APPARATUS FOR MEASURING OR RECORDING DISPLACEMENTS IN RESPECT OF A FIXED REFERENCE SURFACE

During sounding operations in the soil a soil sounding probe with extension tubes is pressed into the soil by means of a pressing device. The resistance encountered by the tip or another part of this probe is continuously measured. To that end use is made of recorders in which the measuring depth is plotted along one co-ordinate, and the tip resistance or another measured quantity is plotted along the other co-ordinate. Generally such a recorder comprises a paper strip which is moved onwards in accordance with the displacement of the soil probe, and the recording stylus is moved along the paper in accordance with the measured quantity. To that end, for instance, a bridge piece coupled with the driving cylinders and pressing against the upper end of a sounding tube or its extension tubes is connected to a string which is guided on guide pulleys and is kept tensioned by means of a counter-weight or the like, which string is wound around the driving pulley of the paper feed of such a recorder.

The recorder and the driving cylinders are generally arranged in a vehicle, and the sounding tube is pressed into the soil by these cylinders through a hole in the floor of this vehicle. The pressure exerted by these cylinders on the sounding tube will relieve the springs of this vehicle, so that the reference plane for determining the depth of the probe is not precisely fixed. The use of supporting feet and/or anchoring screws to be turned into the soil relieving the springs of the vehicle will not provide a solution for this problem since the soil can yield, which will be especially perceivable in the case of soft soil and peak charges. A drawback is, furthermore, that such supporting feet and the like are to be unfastened after each sounding, which will cause a considerable loss of time when performing a large number of soundings at small mutual distances.

Electrically operating compensating devices are known for correcting this error in the zero point of the measurement when the driving means are switched on and off. If, however, the resistance varies during sounding, the reaction force and, therefore, the spring loading will vary accordingly. These known devices are not capable to take into account such fluctuations during sounding.

The object of the invention is to provide a simple apparatus allowing to correct such errors continuously, which apparatus is, for the rest, not restricted to the former application, but can be used in all cases in which similar circumstances occur.

The apparatus according to the invention for compensating movements of a device for measuring or recording displacements in respect of a fixed reference surface is characterized by a subtractor with two inputs and one output, one input being connected to a sensor for the displacement to be measured, and the other input being connected to a sensor for determining the displacement of the support of the first sensor in respect of the fixed surface, the output being connected to an apparatus for indicating or recording the displacement to be measured.

This device can be constructed in various manners, and can comprise mechanical and/or electrical parts.

Figure 2:
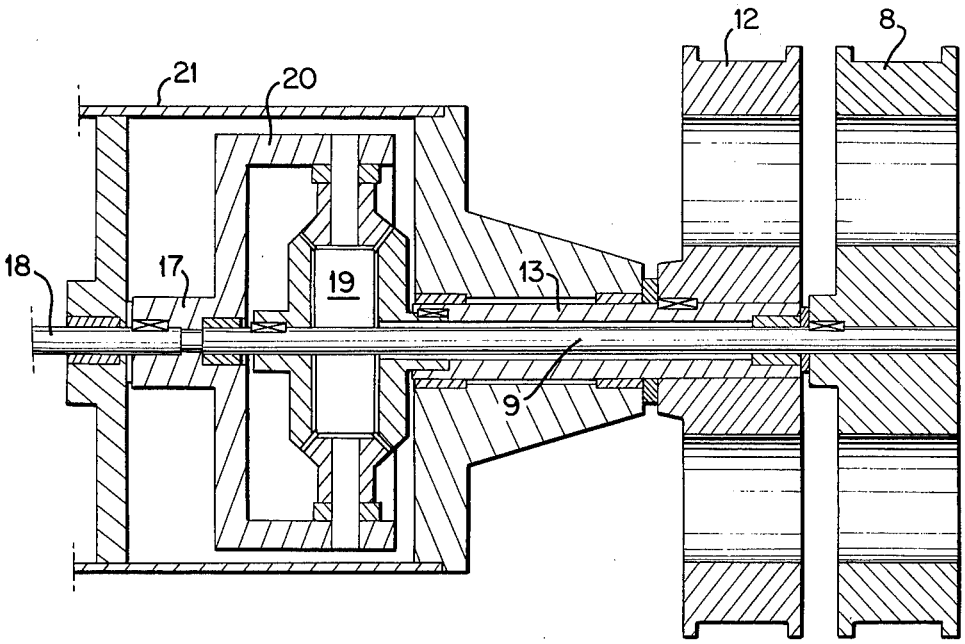

The invention will be elucidated below by reference to a drawing, showing in:

FIG. 1 a highly simplified diagrammatical representation of a soil sounding device provided with an apparatus according to the invention; and FIG. 2 a cross-section of an embodiment of the apparatus of the invention.

In FIG. 1 a supporting surface 1 is shown, for instance the floor of a sounding vehicle, which is resting by means of a resilient support 2 on a fixed soil 3.

A sounding tube 4 is driven into the soil 3 by means of a force indicated by an arrow 5 which is produced by a suitable driving press connected to the surface 1, the resistance encountered by this sounding tube or another measuring quantity as well as the displacement of the sounding tube being recorded by means of a recorder 6. The measuring elements present in the sounding tube are connected, by means of a suitable electrical connection 7, to the recording stylus drive of the recorder 6, the paper feed of this recorder taking place in accordance with the penetration depth of the sounding tube.

To that end the sounding tube 4 is coupled to a sensor 8 connected to the paper feed. In FIG. 1 this sensor 8 is schematically indicated as a friction roller connected to a rotatable shaft 9. However this sensor will generally comprise a pulley around which a string tensioned by a counter-weight is wound, which string is connected to the pressing head of the driving means via suitable guide rollers mounted on the vehicle.

When the pressing force 5 is applied, the floor 1 will be slightly lifted by reaction of the soil so that the spring 2 is relieved, whereas, on removing the pressing force, the spring 2 will be more heavily loaded again. This will also occur, although in a lesser degree, when the reaction force fluctuates, as by changes of the soil resistance. The floor 1 is, therefore, not a true reference surface.

The compensating apparatus according to the invention allows to avoid this objection. This apparatus comprises a weight 10 or the like resting on the soil 3, which weight is coupled by means of a string or rod extending through an opening 11 in the floor 1 to a sensor 12 which can be a pulley in the case of a string and a friction roller in the case of a rod. This sensor 12 is connected by means of a shaft 13 to one input 14 of a subtractor 15, and the shaft 9 is connected to the other input 16 of this subtractor. Its output 17 is now connected to the paper feed drive 18 of the recorder 6. When the floor 1 moves upwards, the sensor 8 will indicate an accordingly too large displacement of the sounding tube 4. The sensor 12, however, determines a displacement in respect of the soil 3 so that the difference appearing at the output of the subtractor 15 represents the true displacement of the sounding tube 4 in respect of the soil 3.

The subtractor 15 can be constructed in various ways. In a simple and very reliable embodiment of this apparatus according to the invention this subtractor comprises a planetary gear system adapted to subtract the rotations of the shafts 9 and 13 from one another. It is, however, also possible to use an electrical subtractor, for instance comprising rotary voltage dividers or angle measuring transformers, the sensors 8 and 12 then being or comprising electromechanical transducers. However such electrical devices are more complicated. A mechanical subtractor can be manufactured with very small dimensions as a water- and dustproof unit which can directly be mounted on the driving shaft of the recorder 6.

FIG. 2 shows a cross-section of such a mechanical device according to the invention. Herein the sensors 8 and 12 are pulleys, the shaft 13 being a hollow one surrounding the shaft 9. The subtractor 15 is a simple planetary gear assembly 19, the output 17 being formed by a shaft connected to a planetary gear cage 20 and coupled to the input shaft 18 of the recorder. The housing 21 surrounding this assembly can be directly mounted on the housing of the recorder.

The pulleys 8 and 12 are connected to, respectively, the driving bridge piece for the sounding tube 4 and the weight 10 resting on the soil.

It will be clear that many modifications are possible within the scope of the invention, and that such an apparatus can also be used for other purposes in which similar circumstances are met with. Furthermore the planetary gear assembly can be substituted for by an equivalent subtractor which is better adapted to a specific arrangement.

I claim:

1. In an apparatus for soil sounding which includes a movable probe supported on a platform of a vehicle which in turn is resiliently supported on the ground wherein the probe is moved downwardly relative to the platform and wherein the platform forms a reference surface, and wherein there is an upward displacement of the reference surface relative to the ground during downward movement of the probe and wherein the position of the probe is monitored by sensor means supported on the platform of said vehicle and movable upwardly therewith in response to upward displacement of the vehicle platform, said sensor means cooperating with the probe and wherein the displacement of the reference surface from the ground creates errors in determining accurately the position of the probe which is movable in a nonuniform manner, the improvement comprising:

means mounted on said vehicle to measure the displacement of the reference surface relative to the ground, said means including:

a. subtractor means mounted on said vehicle and having a first and second input and an output;

b. said sensor means including a first sensor supported on said platform and providing one of said inputs, which input is the sum of the downward displacement movement of said probe relative to the ground and the upward displacement movement of the vehicle platform relative to the ground, said input being greater than the actual displacement of the probe relative to the ground;

c. further sensor means mounted on said vehicle and including means contacting the ground and operative to provide the other of said inputs which is smaller than said one input and which is representative of the displacement of the platform relative to the ground; and said subtractor being a mechanical subtractor operative to subtract from the input which is greater than the actual displacement of the probe the input representative of the displacement of the reference surface relative to the ground.

2. In an apparatus as set forth in claim 1 wherein said sensor means and said further sensor means are mechanical sensors.

3. In an apparatus as set forth in claim 2 wherein said sensor means and said further sensor means are operative to transform the displacements into rotational movement, and said subtractor being a planetary gear assembly.

4. In an apparatus as set forth in claim 1 wherein said apparatus includes means for measuring the resistance of the probe and the displacement of the probe as it enters the ground.

5. In an apparatus as set forth in claim 4 further including means to drive said probe member into the ground, said sensor means being connected to said drive means to provide said one input.

6. In an apparatus as set forth in claim 1 wherein said means contacting the ground is a weight, said further sensor means being a rotatable member, and means coupling said weight to said rotatable member to effect rotation thereof in response to displacement of said reference surface relative to the ground.

7. In an apparatus as set forth in claim 1 wherein said sensor means and said further sensor means each includes separately rotatable members, and means coupling each of said separately rotatable members to said subtractor means to provide said one and said other inputs.

8. In an apparatus as set forth in claim 7 wherein said coupling means includes separate rotatable elements, connected, respectively to each of said rotatable members, and said subtractor means being responsive to the rotation of said rotatable elements to provide said output.

9. In an apparatus as set forth in claim 1 wherein said sensor means and said further sensor means each include rotatable members separately responsive to said displacements, said rotatable members each including means rotatably driven in response to rotation of the members to provide said one and said other inputs, and said subtractor being responsive to the rotation of said rotatably driven means to provide said output.

* * * * *